United States Patent [19]

Bubley

[11] Patent Number: 4,753,162

[45] Date of Patent: Jun. 28, 1988

[54] TURRET BRAKE FOR MULTI-COLOR SCREEN PRINTER

[75] Inventor: Henry J. Bubley, Deerfield, Ill.

[73] Assignee: Advance Process Supply Company, Chicago, Ill.

[21] Appl. No.: 932,691

[22] Filed: Nov. 19, 1986

[51] Int. Cl.[4] ..... B41F 15/10

[52] U.S. Cl. ..... 101/115; 74/823; 188/68; 198/859

[58] Field of Search ..... 188/84, 68; 198/859; 74/824, 823; 101/115, 126; 272/39

[56] References Cited

U.S. PATENT DOCUMENTS

| | | | |
|---|---|---|---|
| 1,029,544 | 6/1912 | Horväth | 101/115 |
| 2,166,716 | 7/1939 | Chandler | 74/823 X |
| 2,485,289 | 10/1949 | Jäne | 101/115 |
| 2,689,986 | 9/1954 | Bedwell | 272/39 X |
| 3,427,964 | 2/1969 | Vasilantone | 101/115 |
| 4,099,460 | 7/1978 | Bubley et al. | 101/115 X |
| 4,493,254 | 1/1985 | Landesman et al. | 101/115 X |
| 4,606,268 | 8/1986 | Jaffa | 101/115 |

FOREIGN PATENT DOCUMENTS

| | | | |
|---|---|---|---|
| 217796 | 1/1910 | Fed. Rep. of Germany | 74/823 |
| 744036 | 1/1956 | United Kingdom | 272/33 R |

OTHER PUBLICATIONS

Operator's Manual American Arrow Multiprinter Mark VI of American Screen Printing Equipment Co.

Operator's Manual Arrow Multiprinter of American Screen Printing Equipment Company.

*Primary Examiner*—Clifford D. Crowder

*Attorney, Agent, or Firm*—Fitch, Even, Tabin & Flannery

[57] ABSTRACT

A multi-color printing apparatus for automatically screen printing workpieces in diverse colors. The apparatus has a plurality of printing units spaced about a central support. A number of radially extending support arms cantilevered from the central support carry the workpiece at their free end for movement between printing units. After being indexed to its approximate final position at a particular station, a brake is engaged to prevent rotation of the support arm and a lock engages the support arm bring the arm into a registered position for the duration of the printing operation, after which the brake and locking bar are disengaged, allowing the support arm to rotate to another printing unit.

9 Claims, 5 Drawing Sheets

Fig. 2
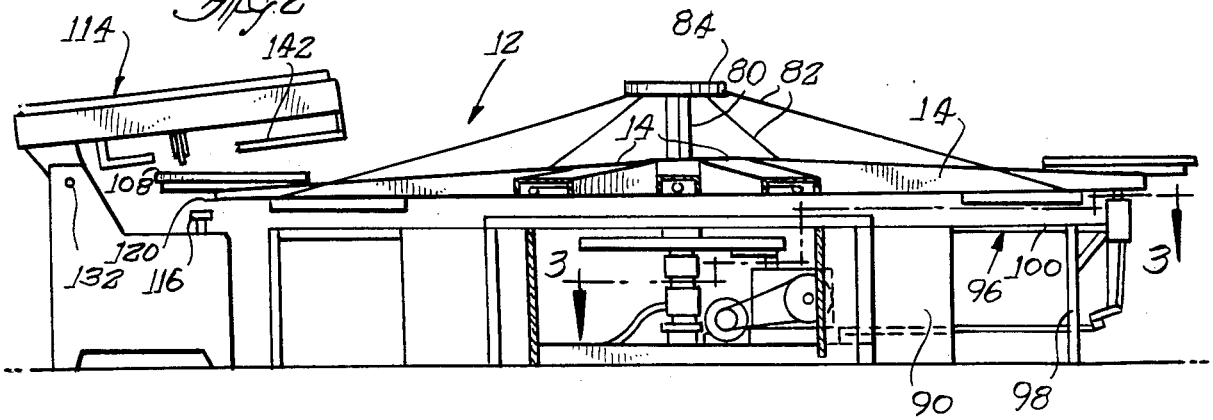
Fig. 6
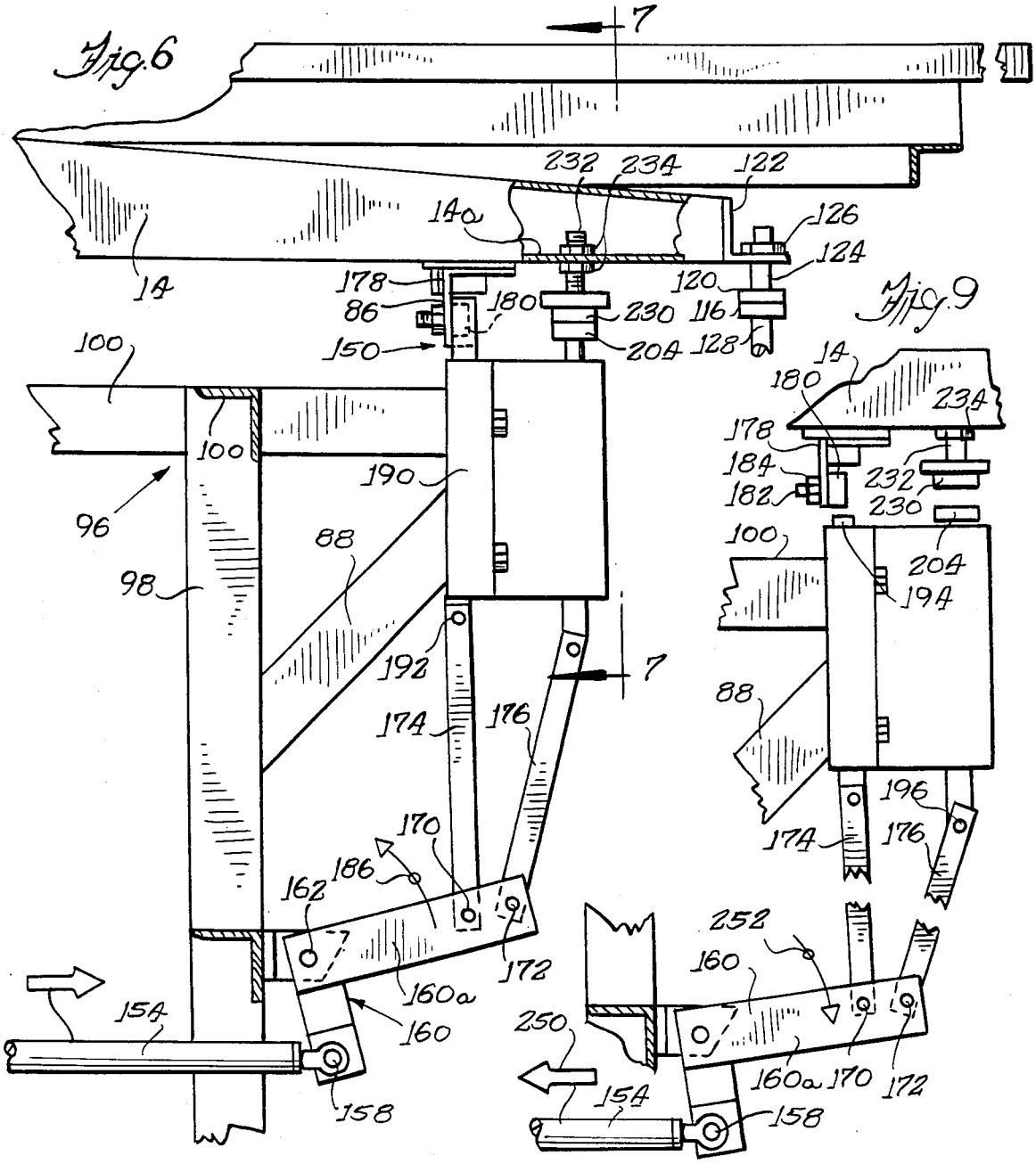
Fig. 9

AIR IN 14
14a
150
206
210
230
204
228
232
234
194a
180
194
244
214
216
218
208
222
212
236
215
202
192
224
88
198
196
200
8

150
228
204
244
216
218
194a
194
214
236
202
222
212
208
198
88
230a
14
240
234
124
230
180
178
204a
215
224
210
192

TURRET BRAKE FOR MULTI-COLOR SCREEN PRINTER

BACKGROUND OF THE INVENTION

1. Field of the Invention

This invention relates to multi-color printing apparatus and, more particularly, to a new, improved arrangement for conveying workpieces between printing stations, and for accurately registering the workpieces at each printing station.

2. Description of the Prior Art

Various methods have been used in the prior art for multi-color screen printing of workpieces including manual and automatic machines. In either of these methods, the workpiece is conveyed to a series of printing stations, each station applying a particular color to the workpiece. Care must be taken to ensure accurate registration of the workpiece at each printing station if the desired multi-colored image is to be attained. The workpiece is carried by a pallet between the various printing stations. Not only must the workpiece be accurately registered initially on the pallet, but also each pallet must itself be accurately registered to each successive printing machine in the printing operation. Significant improvements in turret indexing and registration have been provided by U.S. Pat. No. 4,099,460 issued to Bubley et al. on July 11, 1978 and in a curved Geneva mechanism disclosed in copending patent application Ser. No. 884,540 filed July 11, 1986, now U.S. Pat. No. 4,724,760. The printing arrangement disclosed in that patent includes a central turntable surrounded by a plurality of satellite printing units radially positioned about the turntable. An indexer for rotating the turntable about a central shaft includes a drive disk having equally spaced radially-extending slots for accepting rollers mounted at either end of a rotating drive bar. As the drive arm rotates, a roller enters a slot and continued rotation of the drive arm urges the drive wheel in a circular motion until it emerges from the slot, whereupon the process is repeated with the other roller mounted at the opposite end of the drive bar.

U.S. Pat. No. 4,099,460 also provides registration of each pallet at a printing unit. As cam is provided for rotation with the shaft of the motor which drivingly rotates the drive bar. A roller follower tracks the cam, being raised and lowered thereby at predetermined intervals. The roller is connected to a pivotally mounted arm, causing a free end of the arm to be periodically raised and lowered at a predetermined relationship to the rotation of the drive bar. If the free end of the bar is pinned to a locking member having a forked tip which receives a stub shaft or locking pin cantilevered at one end to the outer edge of the turntable. The lacking member, which is raised and lowered in a generally axial direction, mates with the locking pin upon raising to prevent rotation of the turntable. The forked tip defines a pin-receiving recess closely conforming to the locking pin to ensure accurate registration of the turntable as the pin is received in the recess. The cam is shaped so that, after a printing operation is completed, the roller following the cam is quickly dropped, so as to quickly drop the forked end out of engagement with the locking pin.

While the above-referenced indexing and registration means of U.S. Pat. No. 4,099,460 has proven very satisfactory and has been well-received in the industry, it is now desired to print increasingly larger patterns on workpieces. Not only must larger and more massive pallets supporting the workpieces be moved from printing station to printing station, but the pallets must be located at increasing greater distances from their central drive shaft to allow greater printing strokes in a radial direction. While the forked locking member and lock pin arrangement of U.S. Pat. No. 4,099,460, the curved Geneva mechanism of the aforesaid application have met with great success, larger and more massive turntables are difficult to restrain using this arrangement. The larger mass of the indexer will bang and vibrate if it is a stationary stop before its inertia has been dissipated; also, there may be vibration and bounce. The precise positioning of indexers of ten or twelve foot or more in radius is a difficult problem.

SUMMARY OF THE INVENTION

It is therefore an object of the present invention to provide a new and improved multi-color printer which will allow the quick and accurate successive printing of a plurality of colors on a single object of relatively large size.

It is a further object of the present invention to provide a multi-color printer in which the pallet will be accurately registered during each printing operation despite an increased size of the pallet and/or an increased printing stroke.

Yet another object of the present invention is to provide a new and improved multi-color printer from which the pallet is accurately registered during each printing operation despite significant kinetic energies stored in the indexer which carries the pallet from printing station to printing station.

These and other objects of the present invention are provided in a screen printing press which includes a plurality of rotatably mounted pallets for carrying a workpiece to a plurality of work stations where printing operations are performed on the workpiece. Printing units, one at each work station, include a pivotally mounted printing head and a platen disposed beneath the printing head. The printing head includes a carriage, a squeegee mounted for movement along said carriage to perform a printing stroke, and a printing screen beneath the carriage. The printing head and platen means are movable away from each other to permit movement of the pallet therebetween and movable toward each other for a printing operation. Indexing means rotates the pallets in a continuous series of increments, such that in each increment of rotation, the pallets are positioned at least immediately adjacent respective printing stations. Locking means, engageable with the pallets, cooperate with the indexing means to register and lock the pallets prior to initiation of a printing operation to assure that the pallets are positively locked into desired positions and are accurately registered at respective work stations during a printing operation. The apparatus also includes braking means engageable with at least one of the pallets and cooperating with the locking means to substantially retard movement of the pallets.

BRIEF DESCRIPTION OF THE DRAWINGS

In the drawings, wherein like elements are referenced alike,

FIG. 2 is a sectional elevational view taken substantially along the lines 2—2 of FIG. 1 and looking in the direction of the arrows;

FIG. 6 is an enlarged view of the right hand portion of FIG. 2 showing the brake and locking mechanism in greater detail at a point in operation when the rotating pallet support is locked in position;

FIG. 9 is a partial elevational view of the right hand portion of FIG. 2 taken at a point in operation when the pallet support mechanism is free to rotate, the braking and locking mechanisms of the present invention being cleared therefrom.

DETAILED DESCRIPTION OF THE PREFERRED EMBODIMENT

Figure 1:
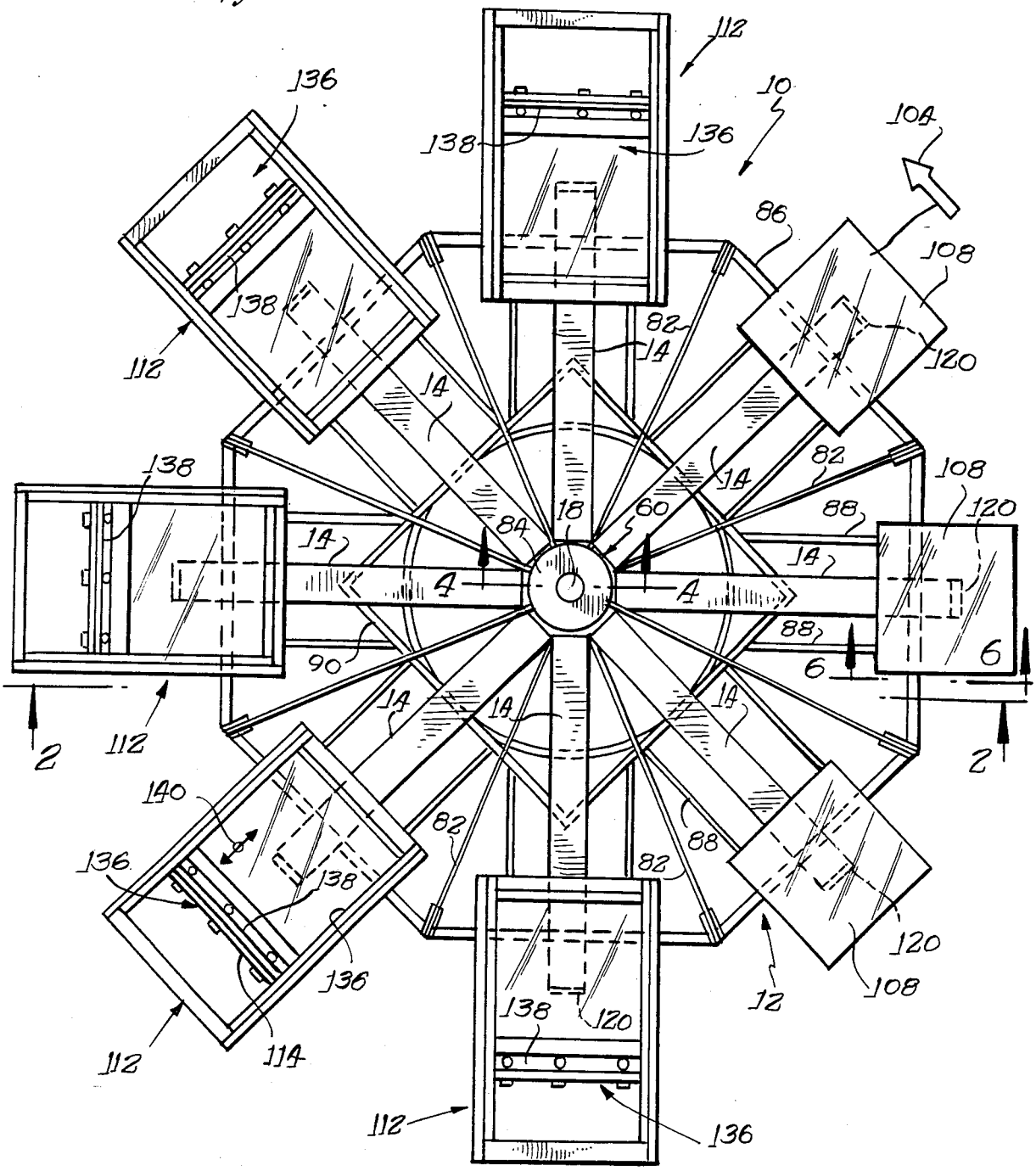
FIG. 1 is a plan view of an improved multi-color printing apparatus embodying the present invention.
Figure 3:
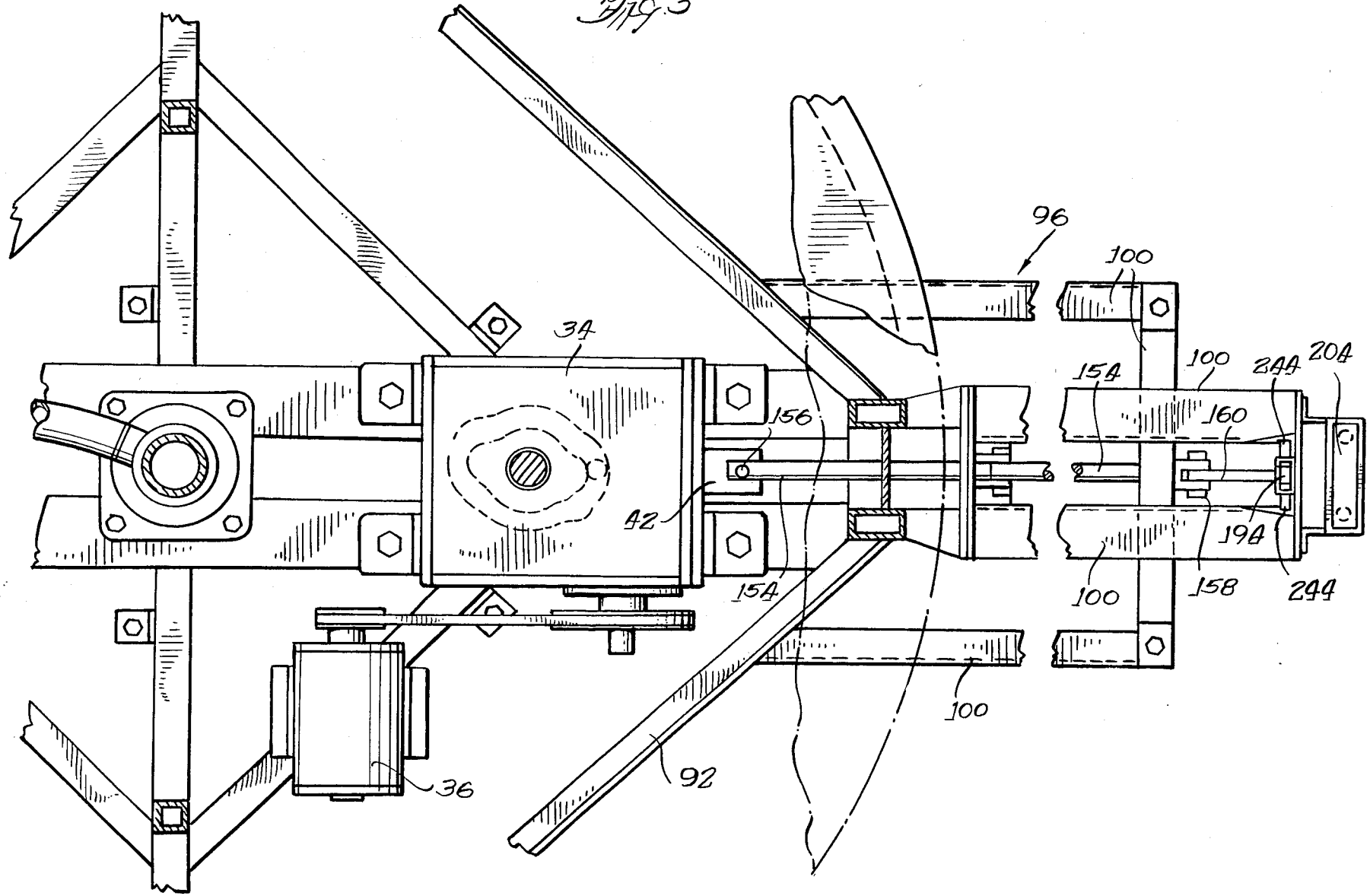
FIG. 3 is a fragmentary sectional view taken in plan substantially along the lines 3—3 of FIG. 2 and looking in the direction of the arrows.
Figures 4, 5, 8:
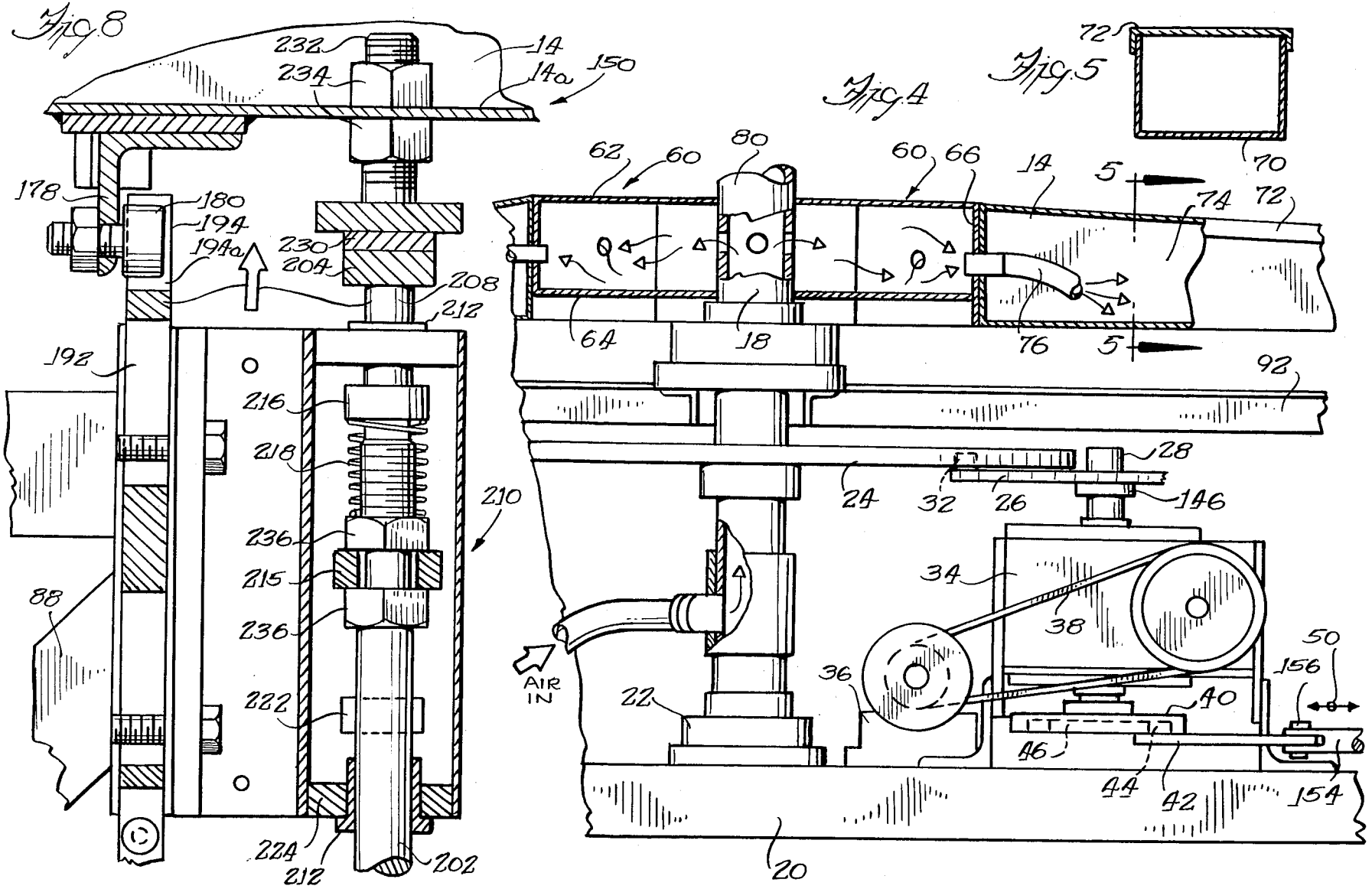
FIG. 4 is a partial sectional elevational view taken substantially along the lines 4—4 of FIG. 1 and looking in the direction of the arrows.
FIG. 5 is an elevational cross-sectional view of a support arm taken substantially along the line 5—5 of FIG. 4 and looking in the direction of the arrows.
FIG. 8 is a partial sectional elevational view taken substantially along the lines 8—8 of FIG. 7 and showing a braking and locking apparatus illustrating the present invention.

Referring now to FIG. 1, there is shown a multi-color printing apparatus 10 including a pallet support mechanism 12 having a plurality of cantilevered conveyor or support beams 14 revolving about a central shaft or axis 18. Referring especially to FIGS. 2 and 4, the central shaft 18 is mounted on a base 20 for rotational movement through suitable bearings in the mounting 22. Mounted on the central shaft 18, for rotation about the same axis, is a drive wheel 24. Slots, not shown in the drawings, are formed in the the underside of drive wheel 24, beginning at a point spaced from the central shaft 18 and extending to the periphery of the drive wheel. The slots are closed on three sides and open on the bottom. A drive arm 26 is mounted for rotational movement about a drive or output shaft 28 on a plane parallel to that of drive wheel 24. Rollers 32 are mounted on opposing ends of drive arm 26 and are received in the slots of the drive wheel. FIG. 4 shows only one half of a drive arm 26, it being understood that the broken portion includes a similar mirrored image on the omitted half. In the illustrated embodiment, output shaft 28 is connected through a gear mechanism 34 which is driven by a motor 36 through a drive belt 38. Also shown in FIG. 4 is a timing wheel 40 driven by mechanism 34 in synchronism with output shaft 28. A link arm 42 has a roller 44 at its free end which follows a slot 46 formed in the underside of timing wheel 40. As timing wheel 40 rotates about its axis, and roller 44 travels in slot 46, link arm 42 reciprocates back and forth in the direction shown in arrow 50. As will be seen later, link arm 42 is connected to a braking and a locking mechanism.

For further details concerning the drive wheel 24, gear mechanism 34, motor 36 and timing wheel 40, see pending patent application Ser. No. 884,540 to Henry J. Bubley et al., which is herein incorporated by reference.

Referring again to FIGS. 1–4, the pallet support mechanism includes a central hub 60 having a octagonal top and bottom walls 62, 64, and eight side walls 66 extending therebetween. Central hub 60 which forms the supporting portion of the rotating conveyor system, is preferably hollow, fabricated from sheet metal members to have a minimum amount of mass and yet provide a strong stable support for the workpieces at the outer free ends of the metal members. In effect, central hub 60 comprises a hollow octagonal box secured to shaft 18 for rotation about a central axis of apparatus 10. As shown most clearly in FIGS. 4 and 5, support beams 14 are, as illustrated, made of sheet metal to form hollow elongated enclosures. In the illustrated embodiment, each channel 14 is formed from a lower trough-like base member 70, generally U-shaped in cross section, and an overlying lid member 72 also U-shaped in cross section. Lid member 72 is easily separable from its underlying base 70 so as to expose the hollow interior cavity 74 which can conveniently accommodate an air line 76 or the like conduits, such as power and control cables connected to operating units located further outwardly along support beam 14.

Referring now to FIG. 2, central shaft 18 includes an upper extension 80 extending above the radial array of support beams 14. A number of support struts 82 are connected to a plate 84 located atop upper extension 80. As seen most clearly in FIG. 1, the outer ends of support struts 82 are connected to an outer octagonal frame 86 which underlies the outer ends of beams 14 providing support therefor. In addition to the upper support struts 82, which are loaded in tension to aid in supporting beams 14, each beam 14 is also supported from below by a number of lower struts 88, which are loaded in compression.

In the illustrated embodiment, a metal enclosure 90 including an internal frame 92 (see FIG. 2) shields the drive wheel 24, gear mechanism 34, motor 36, timing wheel 40 and other associated mechanisms.

As shown most clearly in FIGS. 2 and 6, a radial extension 96 for mounting a locking and braking mechanism extends to the outer periphery of support beams 14. Radial extension 96 includes a vertical support 98 and horizontal angle supports 100. In the illustrated embodiment, only one radial extension 96 is shown since only one locking and braking mechanism is employed. However, similar extensions can be added at other radial positions if additional locking and/or braking is required.

Referring especially to FIGS. 1 and 2, support beams 14, cantilevered from central hub 60 and rotatably supported for rotation in the direction of arrow 104, carry pallets 108 at their respective free ends. Palettes 108, as known in the art, provide a suitable surface upon which a workpiece, to be printed upon, is mounted. In the illustrated embodiment, pallets 108 include an array of apertures (not shown) communicating with the interior cavity 74 of support beams 14. Air line 76 (see FIG. 4) provides a source of vacuum to the interior cavity 74 form an air table with the apertures for releasably holding the workpieces. Suitable valves, not shown in the figures, break the vacuum supply in air line 76 to permit ready unloading of the workpieces from pallets 108.

Referring again to FIG. 2, a plurality of printing units 112 are disposed about the periphery of pallet support mechanism 12. Each printing unit 112 includes a pivotally mounted printing head 114 and a platen 116 positioned beneath the printing head. In the illustrated embodiment, printing head 114 is pivotally mounted at 132 for a movement toward and away from platen 116. As shown most clearly in FIG. 6, platen 116 engages the shoe or slide plate 120 which is bolted to the free end 122 of support beam 14 by means of a threaded shaft 124 and nut 126. Platen 116 is rigidly supported by its mounting shaft 128 so as to be fixed in position during contact with slide plate 120, when pallet support mechanism 12 rotates to approach a registration position for alignment with a printing unit 112. Platen 116 is preferably adjusted on its mounting shaft 128 so that, when it slidingly engages slide plate 120, it slightly raises the free end 122 of support beam 14. The leading end of platen 116 is downwardly tapered for smooth initial engagement with plate 120. For an example of the lifting support provided, in the illustrated embodiment, support beams 14 have approximately an eight foot radius, and the free end 122 of support beam 14 is elevated approximately ¼ of an inch upon contact with platen 116. Thus, platen 116 by supporting the free end of beam 14, provides direct support for a pallet 108 when printing head 114 applies pressure to the pallet and the workpiece carried thereon during a printing stroke.

Referring to FIG. 1, each printing unit 112 has a printing head 114 on which is mounted a squeegee and flood carriage 136 for moving a squeegee and flood bar assembly 136 in the direction of arrow 140 to perform printing in flooding strokes in a conventional screen printing operation. A printing screen is mounted in the printing head and is positioned beneath the carriage so as to contact the upper surface of a workpiece when print head 114 is pivoted in a downward position to perform a printing operation. Further details of the print head, including the carriage, squeegee, and silk screen can be found in U.S. Pat. No. 4,524,687 which is herein incorporated by reference. The lower portion of the arrangement of U.S. Pat. No. 4,524,687 differs in that the present invention accommodates a complete automatic printing operation by including pallet support mechanism 12. However, the disclosure of the upper printing head portion provides description of the printing head of the present invention. Other designs of printing heads can be used with the present invention, it being expressly understood that the present invention is in no way so limited.

In operation, pallet support mechanism 12 is rotated in the direction of arrow 104 (see FIG. 1) to convey a workpiece mounted on a pallet 108 to a succession of printing stations, each having a printing unit 112. Each printing unit 112 prints a different colored design on the workpiece, the differently colored designs applied by each printing unit forming a composite which comprises the desired multi-colored artwork. In order to successfully provide the desired composite artwork, it is essential that the workpiece be correctly registered on a pallet 108 and that, with each step rotation of the pallet support mechanism 12, the pallet 108 is brought into correct registration with a printing unit 112. Each printing operation follows a well defined pattern, and takes place during a 180° rotation of the output shaft illustrated in FIG. 4. Motor 36 is energized causing tne output shaft 28 to rotate until a limit switch contacts a cam 146 to de-energize the motor, stopping rotation of output shaft 28. At this point, the pallet support mechanism 12 is indexed to bring the pallets into registration with adjacent, downstream printing units, the pallet support mechanism being locked in the registered position until tne printing operation ends. At the end of the printing operation, after the printing heads are raised, the output shaft begins rotation to start another printing operation as described.

Figure 10:
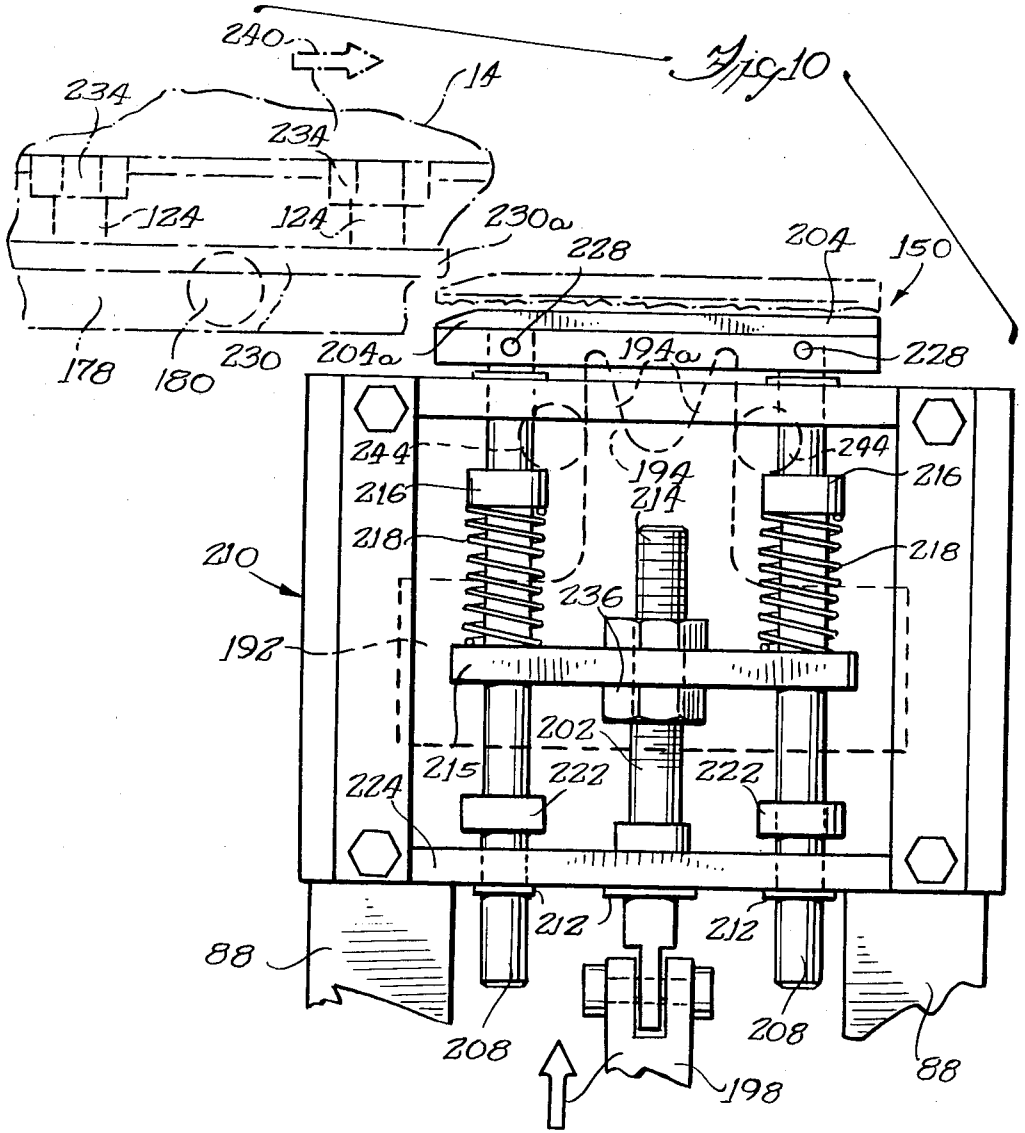
FIG. 10 is a partial cross-sectional view similar to that of FIG. 7 but showing operation immediately before the pallet support mechanism is braked and locked into a registration position.

Operating in timed relationship with the output shaft 28 and a pallet support mechanism 12 is a locking means generally indicated at 150 (see FIGS. 6–10) which registers and locks the pallet support mechanism 12 in the correct position upon indexing of the pallets to succeeding stations. Actuation of the locking means is initiated by timing Wheel 40 attached to the output shaft 28 for following the rotational movement thereof. As described above, a roller 44 is captivated by the timing wheel 40, with displacement thereof causing link arm 42 to reciprocate in the back and forth direction of arrow 50, as shown in the bottom right hand portion of FIG. 4. A link rod 154 is pinned at 156 to link arm 42 and follows the movement thereof. As shown most clearly in FIGS. 6 and 9, the opposing end of link rod 154 is pinned at 158 to a bell crank 160 which is pivotally mounted at 162 to vertical frame member 98. The longer leg 160*a* of bell crank 160 is pinned at 170, 172 to the link arms 174, 176 of locking and braking assemblies, respectively. Link arm 174, which will be considered first, is connected to the locking arrangement illustrated in FIGS. 7 and 10. An L-shaped bracket 178 carries a locking pin 180 have a threaded shaft 182 secured to bracket 178 with a nut 184. As bell crank 160 is pivoted in the counterclockwise direction of arrow 186 (see FIG. 6) link arm 174 is raised too, in turn, because raising of locking plate 190 to which it is pinned at 192. As shown most clearly in FIGS. 7 and 10, locking plate 190 includes an upper forked tip 194 which engages roller pin 180, the pin being cradled in the V-shaped slot of tip 194, to provide a final, accurate registration of beam 14 to a printing unit 112.

Also pinned to bell crank 160 is link arm 176 which operates a braking mechanism engageable with support beams 14 so as to brake the rotation of pallet support mechanism 12 as it is indexed from station to station. The upper end of link arm 176 is pinned at 196 to a connecting link 198, the other end of which is pinned at 200 to an eye bolt 202. Eye bolt 202 provides spring-loaded connection to a brake shoe 204 through a guide rail mechanism 206 which includes a pair of guide rails 208 slidingly mounted in a frame 210. The shaft of eye bolt 202 and the guide rails 208 are mounted in friction reducing sleeve bearings, such as the bearing 212 shown in FIG. 8 which supports the shaft of eye bolt 202. Eye bolt 202 includes an upper threaded end 214 which is bolted to a cross bar 215, which includes apertures for slidingly receiving guide rails 208. Locking collars 216 are fixedly joined to guide rails 208 to hold captive one end of coil springs 218, the other end of which is restrained by cross bar 215.

Lower stop collars 222 are fixedly attached to the lower ends of guide rails 208 for engagement with a lower horizontal member 224 of frame 210 to limit downward displacement of the braking mechanism.

Brake shoe 204 is joined to the upper free ends of guide rails 208 by any convenient means, such as pin connections 228, which preferably comprise roll pins permitting replacement of brake shoe 204.

Figure 7:
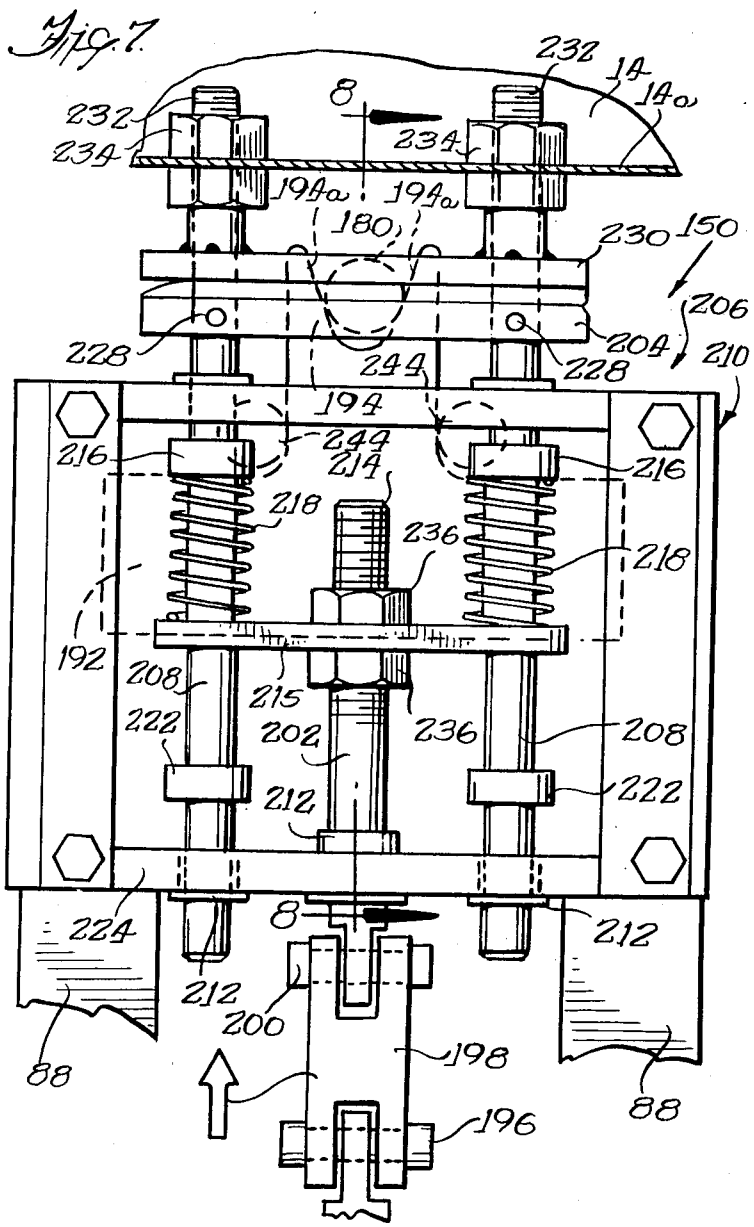
FIG. 7 is a partial cross-sectional view taken substantially along the lines 7—7 of FIG. 6 and looking in the direction of the arrows.

An upper brake pad 230 is mounted with a threaded shaft 232 and nuts 234 to a lower wall 14A of beam 14, as seen most clearly in FIGS. 6 and 7. Necessary adjustments in the position of upper brake shoe 230 can be provided by loosening nuts 234 and threadably adjusting shaft 232. Similarly, the position of lower brake shoe 204 can be adjusted by loosening nuts 236 and threadably adjusting the threaded end 214 of eye bolts 202.

In operation, a timed sequence of events is provided by the present invention as pallet support mechanism 12 is rotated to bring a pallet 108 into registration with a printing station. Due to the relatively large mass and stored kinetic energy in the rotating pallet support mechanism 12 (especially for larger-sized machines), damage or dislocation to the locking tip 194 could result if the tip were immediately brought into engagement with locking pin 180. In order to prevent such damage or dislocation, bell crank 160 is configured for a shorter moment arm connection to the locking mechanism, and a longer moment arm connection to the braking mechanism. That is, as seen most clearly in FIGS. 6 and 9, the link arm 176 for the braking mechanism is pinned at a greater distance from pivot mounting 162 than is the link arm 174 for the locking mechanism. Thus, as link arm 42 is moved to the right in an extended position so as to extend link rod 154, bell crank 160 is rotated in the counterclockwise direction of arrow 186 to impart a movement to link arm 176 and its associated braking mechanism at a point in time that is slightly prior to the displacement of the link arm 174 for the locking mechanism. Thus, referring to FIG. 10, as a support beam 14 approaches the printing station, traveling in the direction of arrow 240, upper brake shoe 230 is brought into position to overlie the leading end 204A of lower brake shoe 204. Lower brake shoe 204 is accordingly provided with a downward beveled surface to provide a smooth interaction between the two brake shoes should the leading edge 204A of the lower brake shoe contact the leading edge 230A of the upper brake shoe 230. It is preferred, however, that threaded shaft 214 be adjusted relative to cross bar 215 so as to raise lower shoe 204 to its upper extended position (shown in phantom in FIG. 10) only after the leading edge 230A of the upper brake shoe has crossed over the leading edge 204A of the lower brake shoe. The lower brake shoe 204 is driven in an upward engaged position so as to come into contact with the upper brake shoe 230 effectively stopping rotation of pallet support mechanism 12 or at least drastically retarding its rotational speed, so as to bring pin 180 into an approximate position above the V-shaped recess of forked tip 194 to allow initial contact of one or both of the inner surfaces 194A of that recess with pin 180.

To confine the forked tip 194 to a well defined path, and to help in absorbing any forces tending to dislocate that forked tip, roller guides 244 straddle forked tip 194 on either side thereof. Rollers 244 are attached to frame 210 with a suitable bracket means, similar to the mounting of roller 180 by bracket 178. To further aid in a smooth operation of the locking mechanism, and to reduce wear on moving parts, pin 180 preferably comprises a roller which is free to rotate about the axis of its threaded mounting shaft when it contacts surfaces **194*a*** of the forked tip.

Bell crank 160 and its pinned connections 170 and 172 are arranged to provide relative timing such that forked tip 194 is raised just after the point in time when rotation of pallet support mechanism 12 is stopped from rotation. After a printing operation has been concluded, motor 36 is again energized to drive output shaft 28 and timing wheel 40 in relative synchronism such that the braking and locking mechanisms are released before the pallet support mechanism 12 is again moved for rotation to bring a pallet into registration with a subsequent, downstream printing station. During this point in operation, link arm 42 is moved to the left in FIG. 4 to assume a retracted position which moves link rod 154 in the direction of arrow 250 (see FIG. 9), causing rotation of bell crank 160 in the clockwise direction of arrow 252. As before, displacement of link arm 176 just slightly precedes the displacement of link arm 174. The pallet support mechanism 12 is thereby cleared for subsequent rotation, and in synchronism with this clearing, the driving mechanism 12 rotates pallet support mechanism 12 in the direction of arrow 104 (see FIG. 1) to bring the pallets into registration with downstream printing stations whereupon the braking and locking sequence is repeated as described above.

Applicants have, according to their present invention, also provided an improved support structure which reduces the kinetic energy stored in the rotating mechanism during indexing from station to station. In this connection, attention is drawn to FIGS. 1, 2, 4, and 5 which illustrate a rotating mechanism 12 consisting of a plurality of spaced-apart radially extending arms which replace the solid table construction of prior art arrangements. To further reduce the mass of the rotating mechanism, each radially extending arm 14 forms a hollow sheet metal construction (as indicated in FIGS. 4 and 5) which provides a convenient enclosure for conduits in addition to reducing the mass of the pallet supporting beam without compromising the structural integrity or rigidity thereof. Beams 14 are mounted as cantilevered members to a central hub 60. To improve the rigidity of the free ends of the beams, the aforementioned open octagonal frame 86 underlies the beams adjacent their free ends. The open frame 86 is in turn supported by struts 82 which are supported at a point above the elevation of the beams 14. If desired, similar light weight struts such as struts 82 can be provided to extend in a downward direction from frame 86 to receive support from the floor, either directly or indirectly, through additional framework. It is noted that the support arrangement of the present invention in particular support each pallet against flutter or unwanted vertical displacements.

From the foregoing, it will be seen that there is an articulated rim brake that may be easily adjusted to time application of the brake engagement in the stopping portion of the indexing cycle so that the indexer is brought smoothly to a stop without abrupt banging or jarring at the time that locking fork engages the locking pin. The articulated rim brake is selectively actuated so that it is not a continuously applied brake that will wear out quickly. The use of the articulated lever actuation of the stationary brake member into engaging the arriving brake member with the articulated lever for the locking form results in an inexpensive positive timed relationship between the braking and locking operations.

The struts and the rim support for the tubular support arms results in a very light weight and very strong structure which hold the work supports against bouncing up and down when engaged by the printing heads. The struts are adjustable rods.

While a preferred embodiment of the invention has been illustrated and described above, there is no intent to limit the scope of the invention to this or any other specific embodiment. It will be understood to those skilled in the art that changes and modifications may be made therein without departing from the invention in its broader aspects.

Various features of the invention are defined in the following claims.

What is claimed is:

1. In a screen printing apparatus for multi-color printing on a workpiece, the combination comprising:

A stationary frame, a rotatable indexer mounted for rotation about a vertical axis in said frame and carrying a plurality of work supports each for supporting a workpiece and for carrying each workpiece into and through a plurality of printing stations, said work supports being located on the circumference of said rotatable indexer and being spaced at least four feet from said vertical axis, an index drive means for driving the indexer through predetermined increments of rotation, a plurality of screen printing units each located at circumferentially spaced positions relative to the indexer and each defining a printing station for printing on a workpiece indexed thereto, an indexer driving means located radially inwardly adjacent the vertical axis of the indexer, a common actuator located radially outwardly of the indexer driving means and at the periphery of said indexer and operated in timed relationship to said indexer driving means, a first locking member on said frame adjacent the outer periphery of said indexer movable by said common actuator, a plurality of second locking members on said indexer each associated with a work support for registration thereof and each brought into a registration position in alignment with and for locking engagement with the first locking member by said common actuator to register the printed workpieces at the respective printing stations, a first brake member on the periphery of said indexer, and a second brake member on said stationary frame located adjacent the periphery of said indexer for movement by said common actuator into braking engagement with said first braking member to dissipate energy to stop rotation of the indexer just prior to said first locking member being moved by said common actuator into locking engagement with the second locking member to register the work stations with the screen printing units.

2. In a screen printing press, the combination of:

a frame, a rotatable turntable on said frame rotatable about a vertical axis, a plurality of rotatably mounted pallet means on said turntable for carrying a workpiece to a plurality of work stations wheeat printing operations are performed on the workpiece, a plurality of printing units located about the periphery of said turntable, one at each work station, each printing unit including a pivotally mounted printing head and a platen means disposed beneath the printing head, said printing head including a carriage, a squeegee mounted for movement along said carriage to perform a printing stroke, and a printing screen beneath the carriage, said printing head and said platen means movable away from each other to permit movement of the pallet therebetween and movable toward each other for a printing operation, indexing means located adjacent said vertical axis for rotating said turntable and said pallet means in a continuous series of increments, such that in each increment of rotation, said pallets are positioned at least immediately adjacent respective printing stations, and locking means engageable with said turntable to register said pallet means, said locking means cooperating with said indexing means for registering and locking said pallet means prior to initiation of a printing operation to assure that said pallet means are positively locked into desired positions and are accurately registered at respective work stations during a printing operation, a plurality of first brake pads spaced circumferentially about the periphery of the turntable and each associated with a work station and each being indexed into a braking position, said first brake pads facing downwardly and having substantially horizontal friction surfaces thereon, and an upwardly facing second brake pad on said frame being located beneath the peripheral path of travel of said first brake pads, said second brake pad having a substantially horizontal friction surface to engage a substantially horizontal friction surface on one of said first brake pads, each of said first brake pads being spaced from vertical alignment with said second brake pad until just prior to termination of one of said increments of rotation at which time one of said first brake pads bridges its horizontal friction surface into vertical alignment and engagement with said brake pad's horizontal frictional surface to substantially retard movement of the turntable prior to said locking means registering and locking said turntable.

3. The combination of claim 2 in which an actuator means operatively connects said indexing means with said locking means and said braking means, said actuator means operative to bring said braking means into engagement with said at least one pallet means prior to said locking means engaging said at least one pallet means.

4. A combination of claim 3 wherein said actuator means includes a bell crank operatively connected at a first end to said indexing means in a timed relationship therewith, and connected at a second end to locking and braking arms which bring said locking means and said braking means into engagement with said pallet means, respectively.

5. A combination of claim 3 wherein said actuator means comprises a connecting arm operatively associated with said indexing means for movement in back and forth directions in synchronism with incremental rotation of said pallet means, and a bell crank which connects said connecting arm to said second brake pad so that said second brake pad is moved in opposing vertical directions in response to said connecting arm moving in said back and forth directions.

6. The combination of claim 5 further comprising compressible spring means through which said bell crank is connected to said second brake pad, said spring means biasing said second brake pad for movement into engagement with said first brake pad as said connecting arm is moved in one of said back and forth directions.

7. The combination of claim 5 wherein said locking means comprises a locking pin fixedly mounted on at least one pallet means, a locking bar moveable in vertical directions and having a first portion engageable with said locking pin, said locking bar connected to said bell crank so as to be displaced for movement toward said locking pin at a preselected time following movement of said second brake pad in a direction for engagement with said first brake pad.

8. The combination of claim 7 wherein said bell crank extends in a generally radial direction and said locking bar is connected to said bell crank at a point radially interiorly of a point where said second brake pad is connected to said bell crank.

9. The combination of claim 2 wherein said pallet means comprises generally hollow, tubular-like support arms radially extending from a central support, carrying a pallet on an upper portion of their free end, and carrying a braking pad on a bottom portion of their free end, said braking pad engageable with said braking means.

* * * * *